US009140088B2

(12) United States Patent
Brooks

(10) Patent No.: US 9,140,088 B2
(45) Date of Patent: Sep. 22, 2015

(54) DOWNHOLE SEVERING TOOL

(71) Applicant: Hunting Titan, Inc., Pampa, TX (US)

(72) Inventor: James E. Brooks, Montgomery, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 13/986,528

(22) Filed: May 13, 2013

(65) Prior Publication Data

US 2013/0284441 A1 Oct. 31, 2013

Related U.S. Application Data

(63) Continuation-in-part of application No. 13/065,937, filed on Jun. 8, 2011, now abandoned.

(51) Int. Cl.
*E21B 29/02* (2006.01)
*E21B 43/1185* (2006.01)

(52) U.S. Cl.
CPC ..... *E21B 29/02* (2013.01); *E21B 43/1185* (2013.01)

(58) Field of Classification Search
CPC ..... E21B 33/063; E21B 43/1185; E21B 43/11857
USPC ..... 102/323, 475, 476; 166/297
See application file for complete search history.

(56) References Cited

U.S. PATENT DOCUMENTS

| | | | | |
|---|---|---|---|---|
| 3,664,262 | A * | 5/1972 | Rose et al. | 102/476 |
| 4,184,430 | A | 1/1980 | Mock | |
| 4,290,486 | A | 9/1981 | Regalbuto | |
| 4,378,844 | A | 4/1983 | Parrish et al. | |
| 6,651,564 | B1 | 11/2003 | Tite et al. | |
| 7,104,326 | B2 | 9/2006 | Grattan et al. | |
| 7,530,397 | B2 | 5/2009 | Bell | |
| 2005/0268776 | A1 | 12/2005 | Bell | |

FOREIGN PATENT DOCUMENTS

EP 0 437 992 * 7/1991

OTHER PUBLICATIONS

Earle H. Kennard: Irrotational Flow of Frictionless Fluids: David Taylor Model Basin, Washington, D.C. Feb. 1967: p. 293.
Paul W. Cooper, Stanley R. Kurowski: Introduction to the Technology of Explosives; Wiley-VCH; 1996; pp. 66,68 &70.
File history of related application, U.S. Appl. No. 13/065,937, filed Jun. 8, 2011, 140 pages.
File history of U.S. Appl. No. 61/342,160, filed Apr. 9, 2010, 32 pages.

* cited by examiner

*Primary Examiner* — Stephen M Johnson
(74) *Attorney, Agent, or Firm* — Arnold, Knobloch & Saunders, L.L.P.; Jason A. Saunders

(57) ABSTRACT

The pipe cutting capacity of an explosive pipe cutter may be improved by directing colliding shock fronts from opposite axial directions against a disc of metal having a shock impedance substantially corresponding to the shock impedance capacity of the explosive material.

8 Claims, 2 Drawing Sheets

DOWNHOLE SEVERING TOOL

CROSS-REFERENCE TO RELATED APPLICATION

The present application is a Continuation-in-Part of application Ser. No. 13/065,937 filed Jun. 8, 2011. Said application Ser. No. 13/065,937 claims the Apr. 9, 2010 priority date of Provisional Application No. 61/342,160.

BACKGROUND OF THE INVENTION

1. Field of the Invention

The present invention relates to the earth-boring arts. In particular, the present invention describes a method and apparatus for severing a downhole tool such as tubing, drill pipe or casing.

2. Description of Related Art

Commercial systems have been around for years to sever pipe at a selected point that becomes stuck downhole. The simplest system detonates a large mass of explosive lowered to a desired point on a wireline to rupture and thereby separate the free, upper end of the pipe string from the stuck, lower end. A better system such as described by U.S. Pat. No. 7,530,397 to W. T. Bell detonates a cylindrical column of explosive simultaneously from both ends to create a shock wavefront collision at the center. The more simultaneous the end detonations and the more uniformly homogenous the explosive column, the better the cut is.

There are a few variations on the colliding shock wave concept. One variation, represented by U.S. Pat. No. 7,104,326 to A. F. Grattan et al, uses a centrally located radial shaped charge to pre-cut the pipe before the explosive shock waves collide. Another variation, such as represented by U.S. Pat. No. 4,378,844 to D. D. Parrish et al., places a metal disc at the center of the collision point with the idea that the-metal will liquefy and form a high-pressure radial cutting jet.

SUMMARY OF THE INVENTION

Described herein are systems and methods for severing a downhole pipe using the mechanism of colliding shock waves. The systems improve on past designs by novel methods of increasing the cutting pressure that severs the pipe. In one embodiment of the invention, the colliding shock waves couple against a centrally located metallic disc having substantially the same shock impedance as the explosive to produce a metallic jet thereby generating a high density, radially expanding jet that delivers a greater cutting pressure against a pipe wall.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

Figure 1:
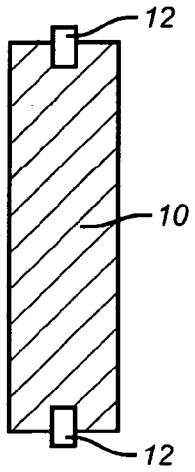
(PRIOR ART) FIG. 1
FIG. 1 is a prior art representation of a cylindrical column of explosive before detonation with detonators at each end of the column. The detonators are configured to fire substantially simultaneously.
Figure 2:
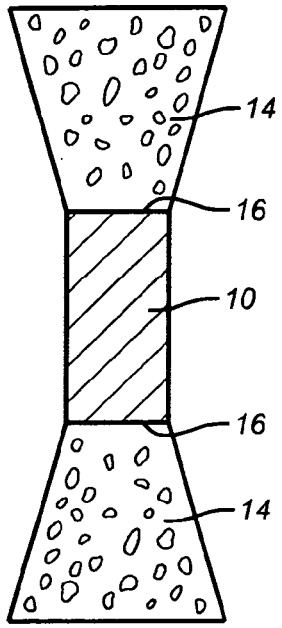
(PRIOR ART) FIG. 2
FIG. 2 is a prior art representation of a cylindrical explosive after detonation with opposing detonation fronts progressing toward collision.
Figure 3:
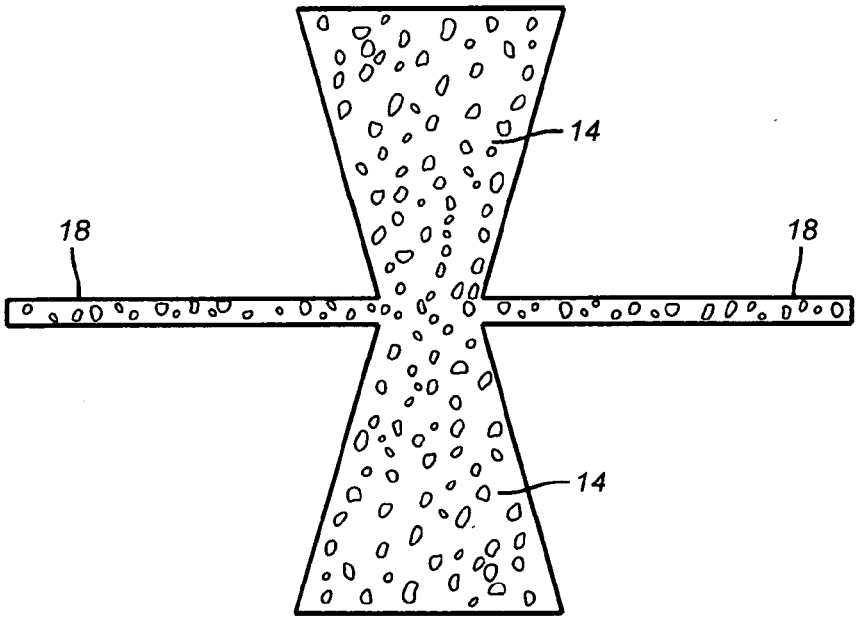
(PRIOR ART) FIG. 3
FIG. 3 is a prior art representation of a completely detonated cylindrical explosive with colliding detonation fronts producing a planar jet of radially expanding explosive gases.

The conventional understanding of the physical mechanism that explosively severs pipe is graphically illustrated by FIGS. 1-3. FIG. 1 shows a column of explosive 10 such as RDX, HNS, PYX, TATB, PETN or HMX. The column may be a material solid or a plurality of pressed pellets or wafers that are contiguously aligned face-to-face in a column as disclosed by U.S. Pat. No. 7,550,357 to W. T. Bell. At opposite ends of the explosive column are respective detonators 12. This FIG. 1 assembly is housed in an environmental protection casement, not shown, with the detonators 12 fused by prescribed length detonation cord or electrically wired EFI's, EBI's or SCBs for simultaneous ignition.

Referring to FIG. 2, simultaneous ignition of the detonators 12 produces a pair of simultaneously advancing shock fronts 16 ahead of expanding gas cells 14. Upon collision of the two shock fronts 16, a localized pressure is produced that may be two to five times greater than the detonation pressure, depending on the simultaneous timing precision of the ignition and resulting collision. As shown by FIG. 3, the high pressure spike generated by the collision of shock fronts 16 spreads the expanding explosion gases radially in a narrowly focused collision plane 18. This radial plane of dense, high pressure gas is transmitted through the tool's housing and wellbore fluid to impinge against the inside pipe wall to sever it.

Figure 4:
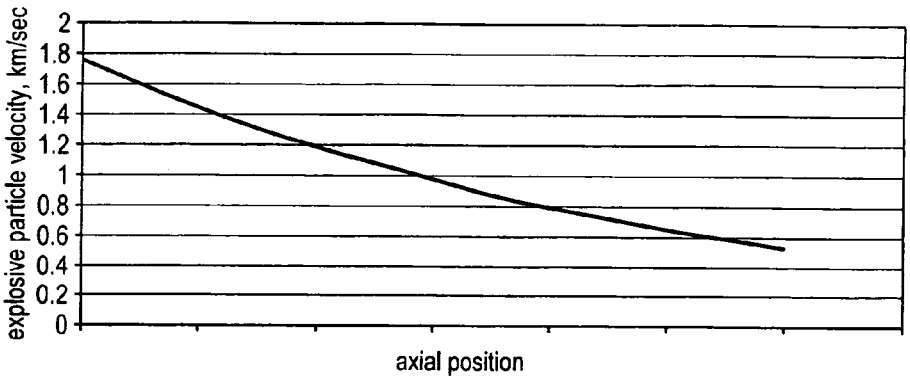
FIG. 4 graphs a typical particle velocity behind the shock front, along the axis of the cylindrical explosive

This description of prior art explosive pipe cutters does not consider the density of the of radially expanding high speed gases that occurs after the shock front collision. There is conservation of axial momentum upon collision with no net axial component. This, in turn, produces the high-speed radial jet of gases that can generate high pressures (upward of one million psi) to cut pipe (having a strength normally of less than 100,000 psi) upon impact much like the jet of a shaped charge penetrates steel. The particle speed, U, of the radial jet is equal to the particle speed of the explosive gas in the column, with the front or tip speed of the radial gas jet approximately equal to 25% of the detonation speed [Cooper, Paul W,:Kurowski, Stanley R.: Introduction to the Technology of Explosives, Wiley VCH, Inc. 1996] and the remaining jet having progressively reduced speed as the particle flow of the gas from the trailing column is diverted radially from the column axis (see FIG. 4). The radial expansion of the jet reduces the density of gases. In this description, as with a shaped charge, jet velocity is not particularly relevant provided the resulting near-field jet pressure impacting the pipe is much higher than the strength of the pipe being cut. The parameter that determines cutting ability in this description is jet density. The greater the density of the jet gas, which is related directly to the explosive density, the deeper the cut. To improve the cutting capacity of such explosive pipe cutters, the present invention, therefore, proposes a radial jet having a greater cutting pressure than conventional devices.

With this more complete view of the physics contributing to explosive pipe cutting, explosive gas density is seen as an important factor. By increasing gas density we can improve cutting ability. However, there are relatively small differences in density of the various common explosives, with less than 10 percent difference between the RDX and HMX, for example. Disclosed herein are two methods of increasing radial jet density delivered by a severing tool, and thereby increasing its cutting ability.

Metallized Explosive.

Figure 5:
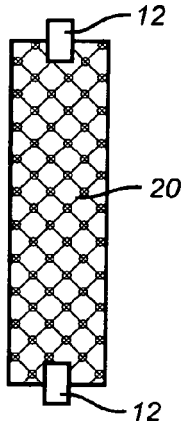
FIG. 5 represents an undetonated cylindrical column of explosive having detonators at each end configured to fire substantially and an explosive composing of a mixture of explosive and metal powder.

Metals, such as aluminum, have been added to explosives by the prior art to increase the time duration of the explosive event through a reaction (i.e. burning) of the metal by the explosive gases. See U.S. Pat. No. 6,651,564 to Tite, et al. For this application, however, explosive density $\rho_0$ is increased by mixing powered metals with the base explosive as represented by the explosive column 20 of FIG. 5. This explosive/powdered metal mixture 20 increases the density of the mixture to a magnitude greater than that of the explosive alone and thereby increases the density of the radial gases that are produced when the shock fronts 16 collide. Metals that react with the explosive gases and those that are non-reactive are candidates, including powders of one or more of the following: aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium. Powders of these elements may be used in mixed combination with the explosive either singularly or in blended combination.

As an example, a 50/50 weight mixture (86/14 volume mixture) of HMX and lead powder would increase the overall explosive density from 1.75 g/cc to about 3.1 g/cc. In the case of lead with its melting temperature, the explosive gases would contain higher density (in gaseous or liquid state) lead in addition to the HMX gaseous products. The resulting radial jet would have a higher density, generating higher cutting pressure. A greater percentage of lead would increase the mixture density more, but would simultaneously reduce the explosive's overall detonation speed. A 55/45 weight mixture (86/14 volume mixture) of HMX and copper powder would increase the explosive density to about 2.8 g/cc, as another example of this approach.

Centralized Metal Disc.

Figure 6:
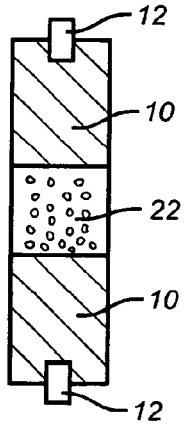
FIG. 6 represents an undetonated cylindrical column of explosive having detonators at each end configured to fire substantially simultaneously. The column is assembled with a powdered metal disc at the center having a shock impedance matching the shock impedance of the explosive column.
Figure 7:
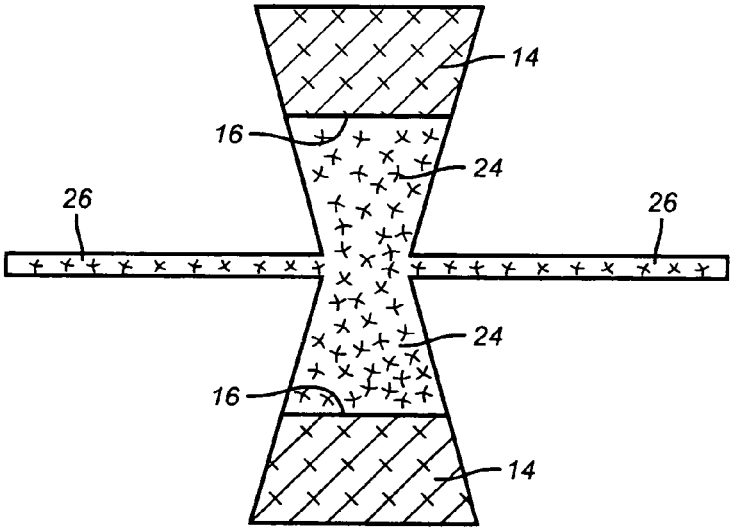
FIG. 7 represents a completely detonated cylindrical explosive with detonation fronts colliding against a powdered metal disc as represented by FIG. 6 to produce a planar jet of radially expanding gasses comprising the powdered metallic material.

An alternative embodiment of this invention creates a metal radial jet by inserting one or more metal discs 22 at the center of the explosive column as represented by FIG. 6. As the opposing shock fronts 16 of FIG. 7 converge on the metallic disc 22, some of the explosive energy is converted into a radial jet 26 composed of high density liquid metal 24 that would cut pipe. This approach was broadly described by U.S. Pat. No. 4,378,844 to D. D. Parrish et al. The analytical mathematics of two equal colliding liquid streams that corresponds to one stream impacting a solid wall is well known and is described by the Earle H. Kennard study of Irrotational Flow of Frictionless Fluids, Mostly of Invariable Density published by the David Taylor Model Basin, Washington, D.C., February 1967, for example.

However, Parrish et al did not recognize and certainly did not disclose the dynamic consequence of shock impedance, which is the product of the at-rest density of the material times the speed of propagation of the shock wave in that material. The shock impedance of the lead disc described by Parrish as an example, is greater than that of the impinging explosive. Considering the lead example described by Parrish et al, the shock impedance (density times shock speed) of a solid metal disc (density=11.3 g/cc, shock speed=2.0-2.8 km/sec) is 1.5-2.5 times that of the explosive (density=1.75 g/cc; detonation speed=8 km/sec), causing strong reflected energy to be propagated back through the explosive thereby reducing the magnitude of transmitted energy. This action results in a weakened collision of shock fronts 16 at the center of the disc and a reduced energy imparted to the radial jet 26.

An improved alternative to the same idea would be to make a metal disc that has substantially the same shock impedance of the impinging explosive. One way to match the shock impedances is to form the disc of compressed metal powder rather than as a solid article. As an example, a compressed powder lead disc with 25% porosity would approximate the shock impedance of HMX, as would a powdered copper disc of about 35%. With the matching shock impedances at the interface between the explosive and the disc, the explosive pressure shock is transmitted directly to the metal disc, with a collision that produces the desired high density metallic radial jet (see FIGS. 6 and 7).

One version of this concept would have alternating explosive pellets and impedance-matched pressed powdered discs of reactive metal located along the column and concentrated near the center collision plane. Discs composed of reactive metals burn after the shock passes through to prolong the duration of the resulting near-field pressure at the severing point. Combined with the metallic jet cutting action, the higher sustained near-field pressure adds to the effectiveness of the cut. The explosive in the centrally localized stack of reactive metal discs and explosive pellets can be HMX, for example, or a mixture of HMX and reactive powdered metal particles.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. An explosive cutting system comprising:

a substantially cylindrical column comprising a coaxial alignment of at least one metallic disc contiguously between adjacent cylinders of high explosive material, the shock impedance of said disc or discs being substantially the same as the shock impedance of said explosive material; and an explosive detonator at opposite ends of said column.

2. An explosive cutting system as described by claim 1 wherein the cylinders of high explosive material each comprise a plurality of contiguously aligned pellets of high explosive material.

3. An explosive cutting system as described by claim 1 the at least one metallic disc comprises, a centralized stack of pressed discs of reactive metal and discs of high explosive material.

4. An explosive cutting system as described by claim 3 wherein the shock impedance of the discs of reactive metal is substantially the same as the discs of high explosive material.

5. An explosive cutting system as described by claim 1 wherein the at least one metallic disc comprises a mixture of reactive metal and high explosive material.

6. An explosive cutting system as described by claim 1 wherein said high explosive material is selected from the group consisting of HMX, RDX, HNS, PYX, TATB and PETN.

7. An explosive cutting system as described by claim 1 wherein said metallic disc or discs comprises an integral compression of powdered material selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium.

8. An explosive cutting system as described by claim 1 wherein metal in said metallic disc or discs comprises one or more elements selected from the group consisting of aluminum, copper, lead, tin, bismuth, tungsten, iron , lithium, sulfur, tantalum, zirconium, boron, niobium, titanium, cesium, zinc, magnesium, selenium, tellurium, manganese, nickel, molybdenum, and palladium.

* * * * *